US006513808B2

(12) United States Patent
Fang

(10) Patent No.: US 6,513,808 B2
(45) Date of Patent: Feb. 4, 2003

(54) CUBIC PUZZLE

(76) Inventor: Chih Chung Fang, No. 566, Chung Hua Road, Pa Te, Taoyuan Hsien (TW)

( * ) Notice: Subject to any disclaimer, the term of this patent is extended or adjusted under 35 U.S.C. 154(b) by 0 days.

(21) Appl. No.: 09/851,116

(22) Filed: May 9, 2001

(65) Prior Publication Data

US 2002/0167127 A1 Nov. 14, 2002

(51) Int. Cl.[7] ..... A63F 9/08
(52) U.S. Cl. ..... 273/153 S
(58) Field of Search ..... 273/153 S, 157 R, 273/153 R, 156, 155

(56) References Cited

U.S. PATENT DOCUMENTS 3,845,959 A * 11/1974 Kosarek ..... 273/153 S
4,424,971 A * 1/1984 Clark ..... 273/153 S
4,432,548 A * 2/1984 Kassan ..... 273/153 S
5,310,183 A * 5/1994 Glikmann ..... 273/153 S
5,857,673 A * 1/1999 Ablonczy et al. ..... 273/153 S

FOREIGN PATENT DOCUMENTS

| | | | | |
|---|---|---|---|---|
| DE | 4106826 | * | 9/1991 | ..... 273/153 S |
| GB | 2177929 | * | 2/1987 | ..... 273/153 S |
| WO | 8907968 | * | 2/1989 | ..... 273/153 S |

* cited by examiner

*Primary Examiner*—Steven Wong
(74) *Attorney, Agent, or Firm*—Troxell Law Office PLLC

(57) ABSTRACT

A cubic puzzle includes a combination cube formed of a center base block and a set of puzzle blocks horizontally vertically aligned around the center base block, and cubic open holder frame holding the combination cube on the inside, the puzzle blocks being shifted in the cubic open holder frame to change the combination after removal of an assigned puzzle block from the cubic open holder frame.

6 Claims, 17 Drawing Sheets

CUBIC PUZZLE

BACKGROUND OF THE INVENTION

The present invention relates to a puzzle and, more particularly, to a cubic puzzle, which includes a cubic holder frame, and a set of cubic puzzle blocks attracted to a magnetic center base block within the cubic holder frame and shifted from position to position to change the combination.

A conventional cubic puzzle, as shown in FIG. 1, is comprised of a set of cubic blocks arranged together to form a combination cube. The cubic blocks each have the six sides respectively marked with a particular design. The user can turn the cubic blocks horizontally or vertically to change the combination. According to this design, the corner cubic blocks cannot be shifted to the center at each of the six sides of the combination cube. Further, the cubic blocks cannot be shifted individually. Because of the aforesaid limitations, this design of cubic puzzle is less attractive. There are also known planar puzzles (picture puzzles) respectively formed by cutting a sheet of picture into pieces. When playing the game, the pieces are put together to show the picture. Because a player can quickly find the way to put the pieces together to show the picture after few times in trial, these planar puzzles cannot attract older children.

SUMMARY OF THE INVENTION

The present invention has been accomplished under the circumstances in view. It is one object of the present invention to provide a cubic puzzle, which enables the player to shift every individual cubic puzzle block from position to position around a center base block to change the combination. It is another object of the present invention to provide a cubic puzzle, which can be all detached and reset to achieve maintenance work easily. According to one embodiment of the present invention, the cubic puzzle includes a cubic holder frame, the cubic holder frame having six open sides and peripheral ribs connected to one another around the six open sides, and a set of cubic blocks set in the cubic holder frame to form a combination cube, the cubic blocks including a magnetic center base block, and a plurality of puzzle blocks horizontally vertically aligned within the cubic holder frame around the center base block and shifted from position to position around the center base block within the cubic holder frame to change the combination of the cubic blocks, the puzzle blocks being hollow cubic blocks each having the respective six sides externally marked with a respective design and internally mounted with an iron sheet for being attractable to the magnetic center base block. The side length of the center base block is slightly greater than the puzzle blocks about 0.6 mm~1 mm longer), so that the center base block is positively secured in place when shifting the puzzle blocks. In another embodiment of the present invention, the cubic puzzle comprises a set of cubic blocks arranged together and forming a combination cube, the cubic blocks including a solid center base block and a plurality of puzzle blocks horizontally vertically aligned around the solid center base block, the puzzle blocks being hollow cubic blocks each having the respective six sides externally marked with a respective design and internally mounted with an iron sheet and four side edges of each of the respective six sides chamfered, and a transparent cubic holder frame adapted to hold the cubic blocks for enabling the puzzle blocks to be shifted with a magnetic stick from position to position around the center base block to change the combination of the cubic blocks, the transparent cubic holder frame being a cubic case having an open side covered with a detachable cover plate. In still another embodiment of the present invention, the cubic puzzle comprises a cubic holder frame, and a set of cubic blocks set in the cubic holder frame to form a combination cube, the cubic blocks including a center base block, and a plurality of puzzle blocks horizontally vertically aligned within the cubic holder frame around the center base block and shifted from position to position around the center base block within the cubic holder frame to change the combination of the cubic blocks after removal of one of said puzzle blocks. According to this alternate form, the cubic holder frame comprises six latticed rectangular open sides each defining a plurality of transversely longitudinally aligned rectangular open spaces of size greater than the puzzle blocks, and the puzzle blocks include one insert puzzle block of relatively smaller size that is removed from the cubic holder frame before starting the game.

DETAILED DESCRIPTION OF THE PREFERRED EMBODIMENT

Figure 1:
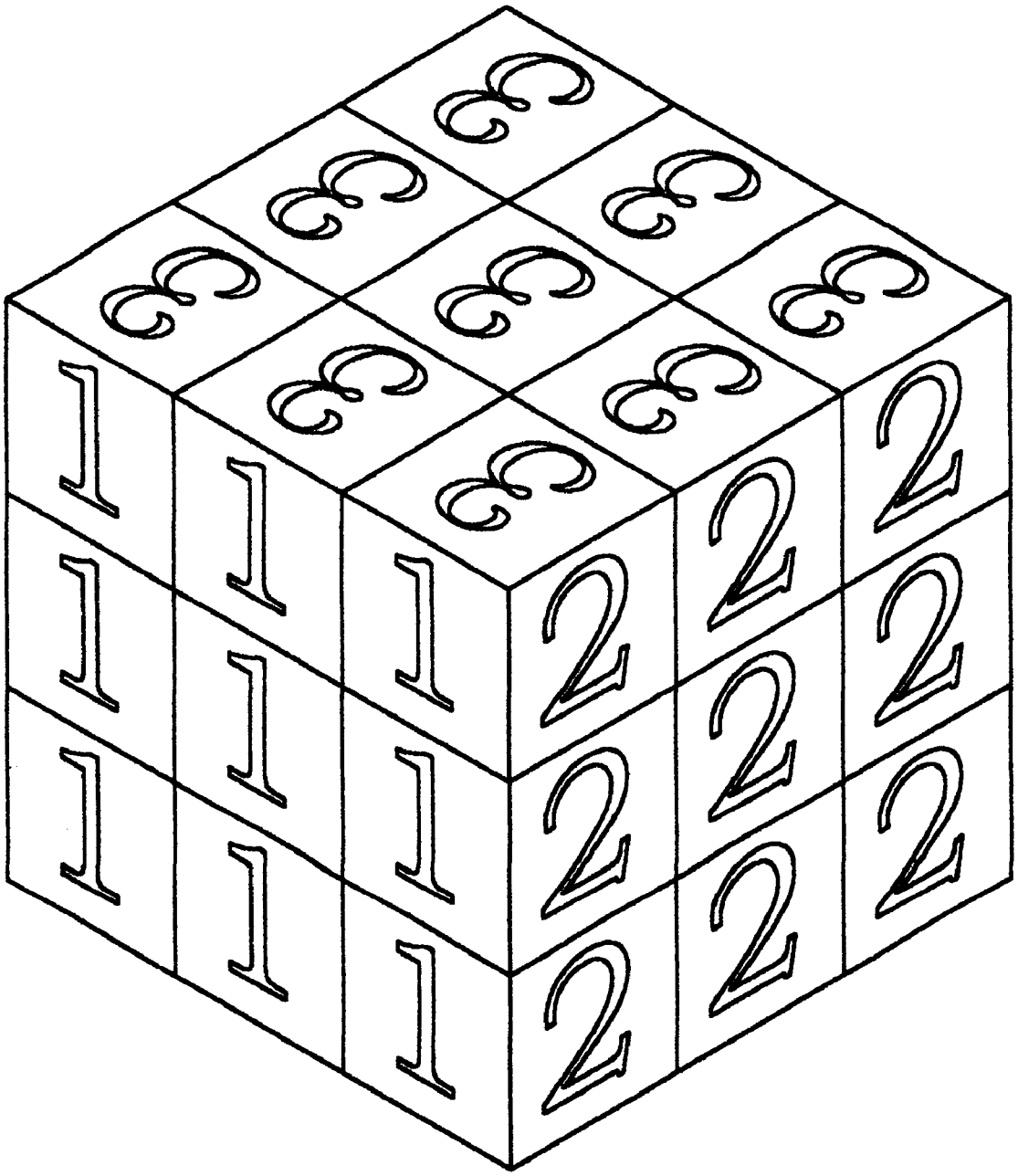
Prior Art FIG. 1
FIG. 1 is an elevational view of a cubic puzzle according to the prior art.
Figure 2:
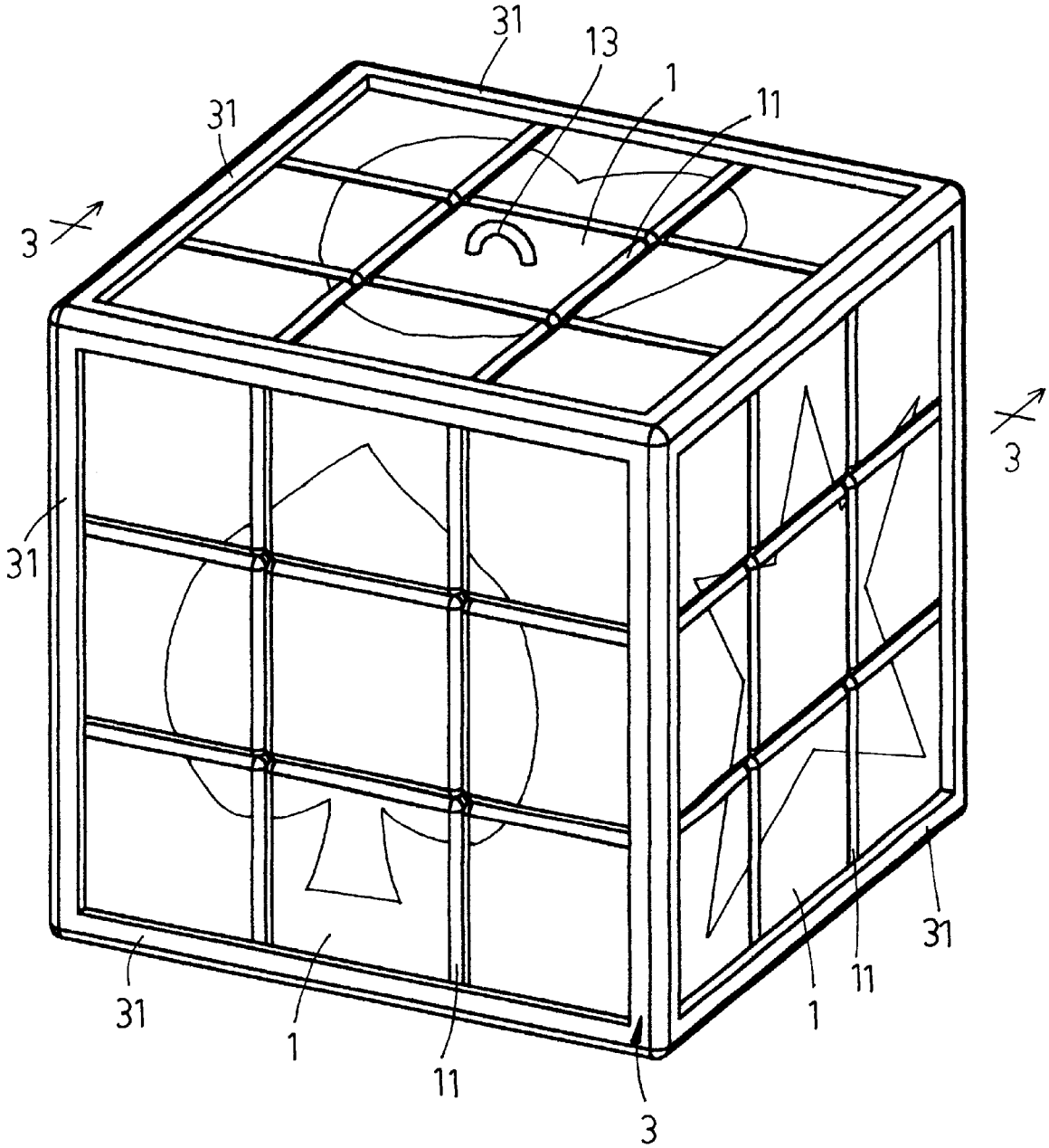
FIG. 2 is an elevational view of a cubic puzzle according to one embodiment of the present invention.
Figure 3:
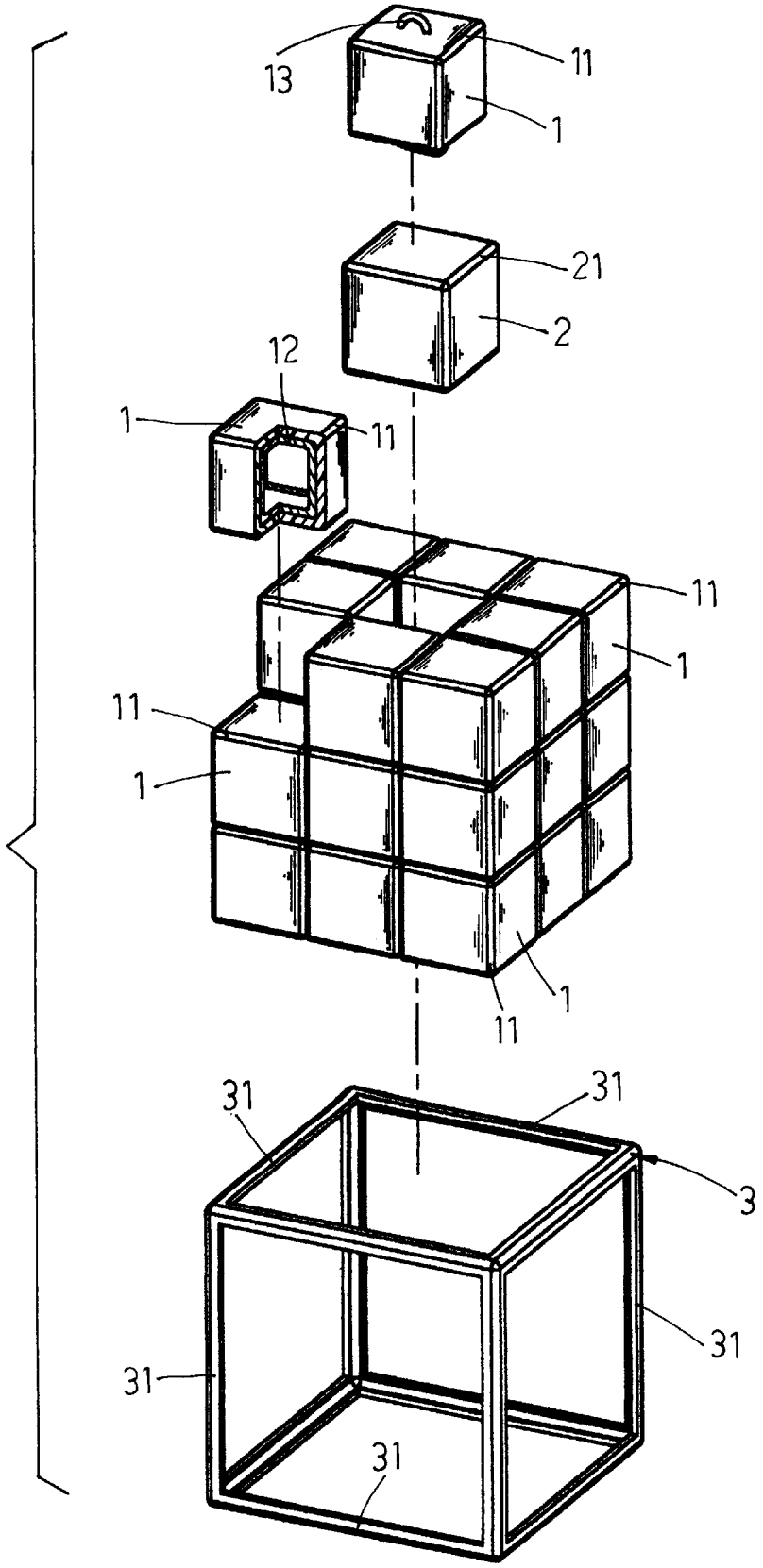
FIG. 3 is an exploded view, partially cutaway, of the cubic puzzle shown in FIG. 2.
Figure 4:
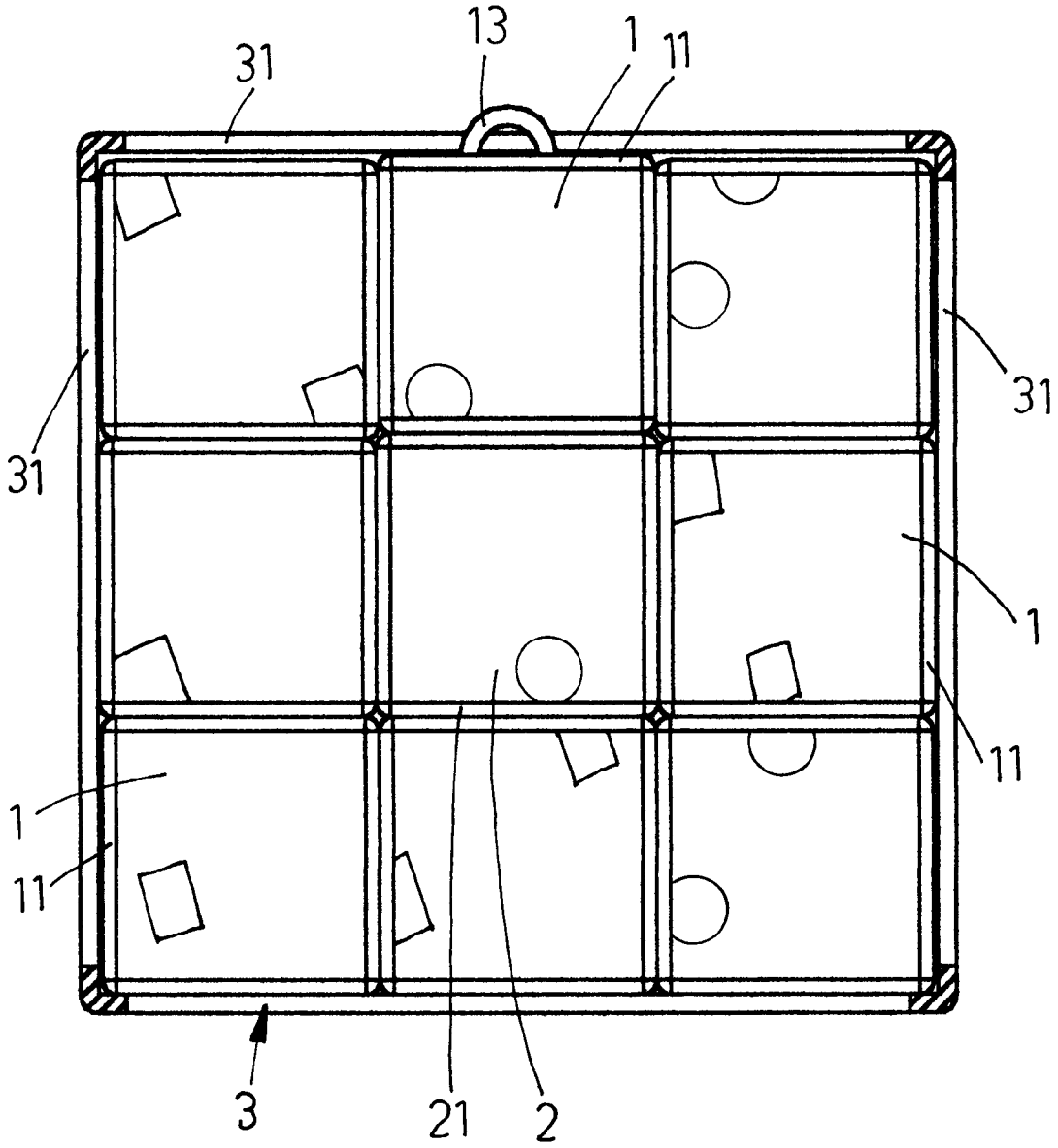
FIG. 4 is a sectional view taken along line 3—3 of FIG. 2.
Figure 5:
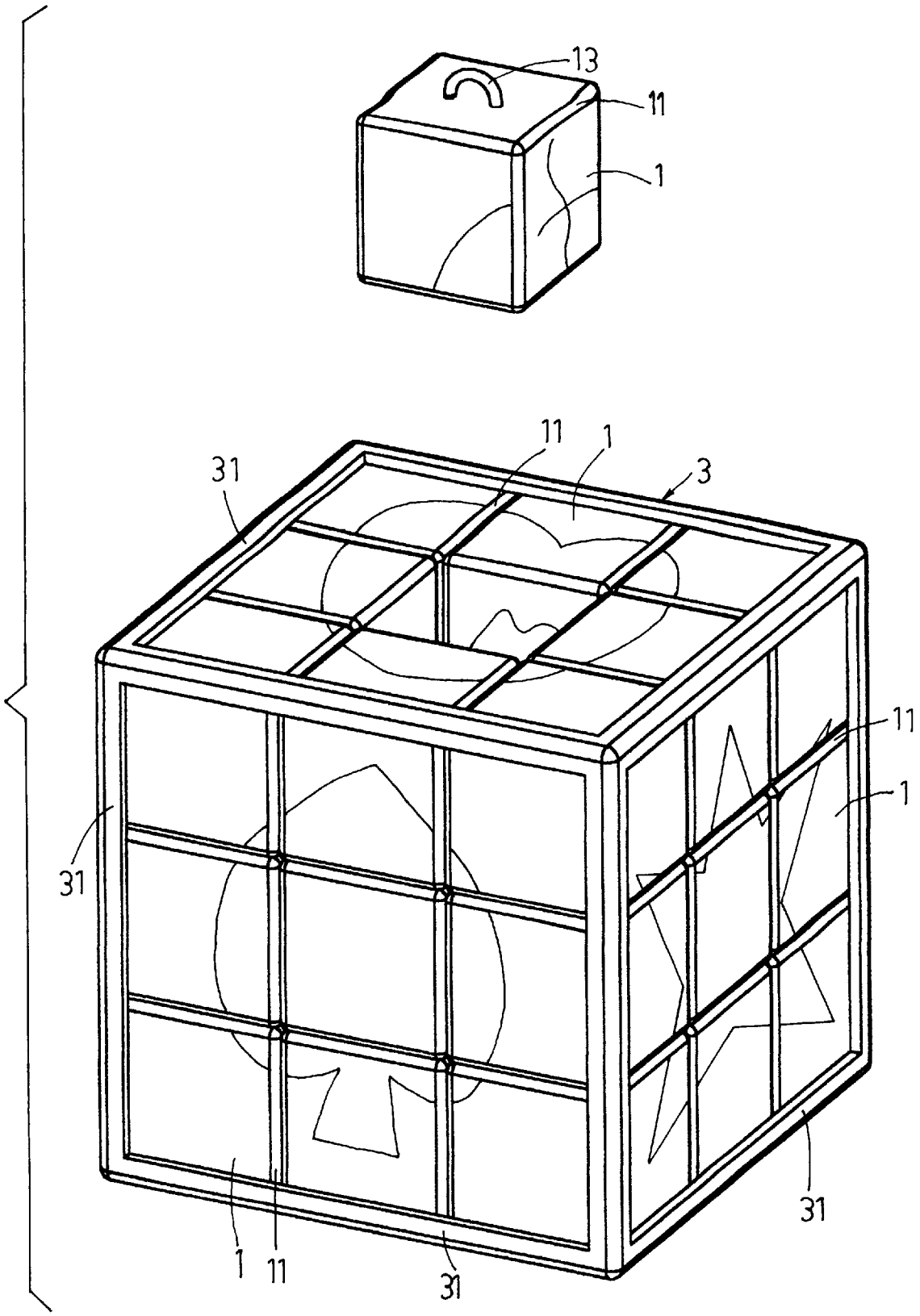
FIG. 5 is an exploded view of an alternate form of the cubic puzzle according to the present invention.
Figure 6:
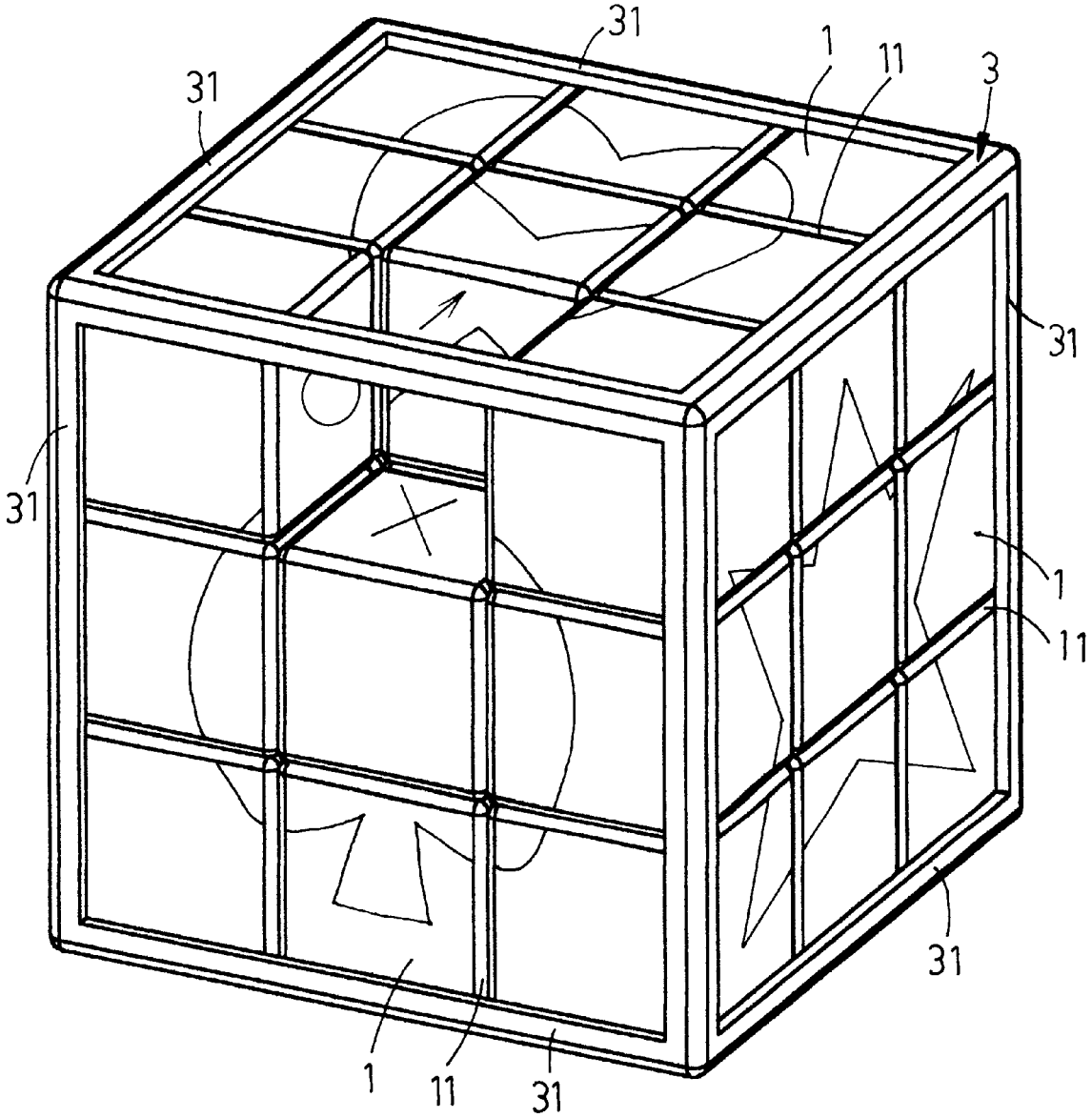
FIG. 6 illustrates the cubic puzzle of FIG. 5 shifted.

Referring to FIGS. from 2 through 6, a cubic puzzle in accordance with the present invention is shown comprised of a cubic holder frame 3, and 27 cubic blocks arranged into a combination cube and received in the cubic holder frame 3. The cubic holder frame 3 has six open sides, and peripheral ribs 31 connected to one another around the six open sides. The 27 cubic blocks include a center base block 2 and 26 puzzle blocks 1. The center base block 2 has its six sides kept in plain without drawing. The 26 puzzle blocks 1 are hollow blocks each having the respective six sides marked with a respective particular design, and an iron sheet 12 on the inner surface of each of the respective six sides. The center base block 2 is a solid magnetic block that attracts the puzzle blocks 1 by magnetic attraction. The side length of each side of the center base block 2 is slightly greater than the puzzle blocks 1, so that the puzzle blocks 1 stop against the angles of the center base block 2 and the center base block 2 is prohibited from displacement when operating the cubic puzzle (see FIG. 4).

Referring to FIGS. from 4 through 6, because the size of the center base block 2 is slightly greater than the puzzle blocks 1, the center base block 2 is stopped at the center of the cubic puzzle, and every puzzle block 1 has one side attracted to the center base block 2 when moving over the center base block 2. In order to keep the blocks 1 and 2 in place, the cubic holder frame 3 is used. One puzzle block 1 has one side fixedly mounted with a pull ring 13. Through the pull ring 13, the puzzle block 1 is taken away from the other blocks 1 and 2, leaving a cubic space for the shifting of the other blocks 1 and 2 to change the combination of the cubic puzzle. When moving the puzzle blocks 1 to change the combination, the peripheral ribs 31 of the cubic holder frame 3 stop the border puzzle blocks 1 from falling out of the cubic puzzle, and the center puzzle block 1 at each side is attracted to the center base block 2. Therefore, the puzzle blocks 1 are maintained in place when the user shifts the puzzle blocks 1 to change the combination of the cubic puzzle. Because each of the six sides of each puzzle block 1 has a particular design, the user can shift the puzzle blocks 1 to alternatively show the design of each side of each puzzle block 1, and there are totally a big number of combinations available.

Figure 7:
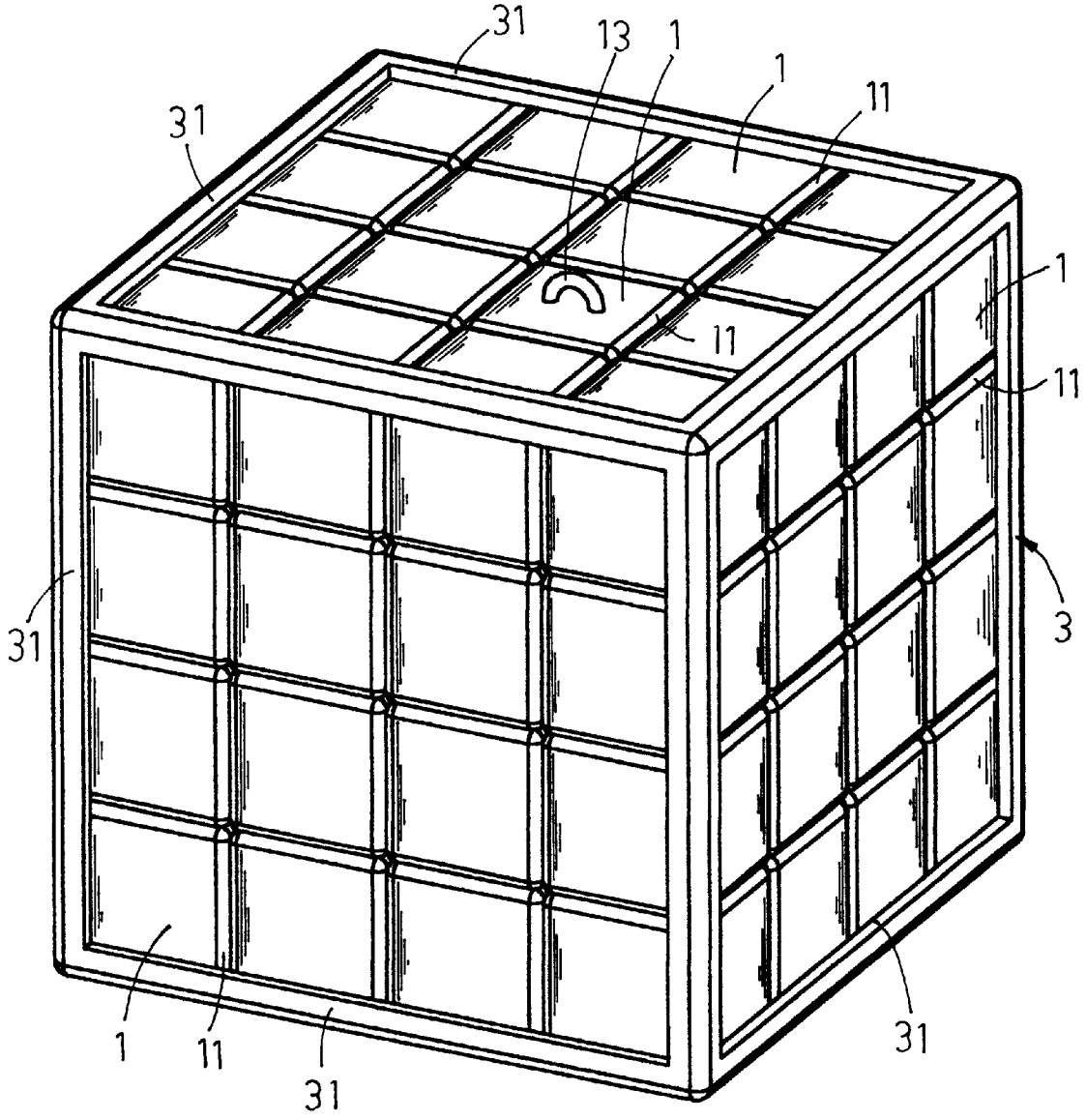
FIG. 7 illustrates another alternate form of the cubic puzzle according to the present invention.
Figure 8:
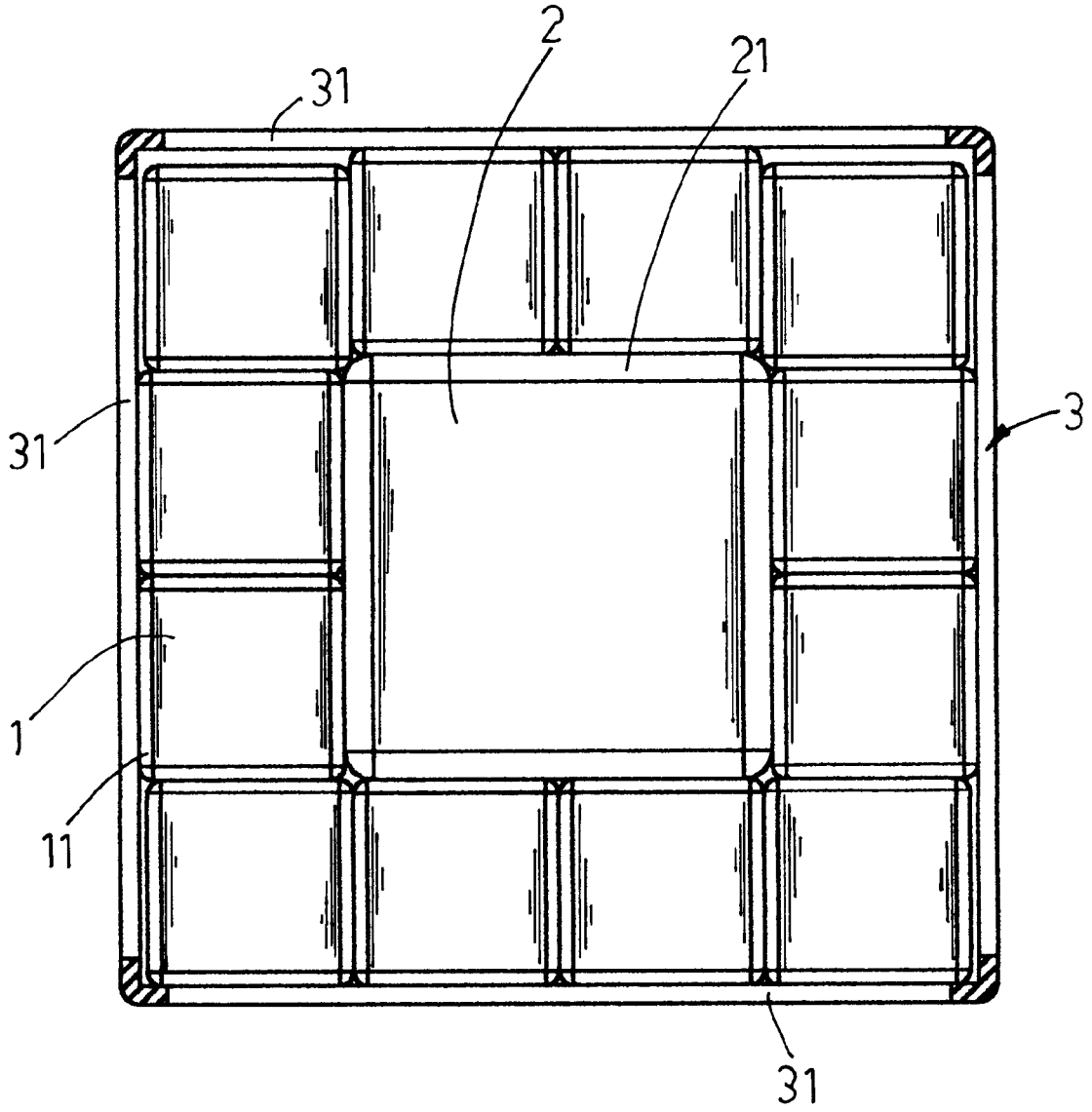
FIG. 8 is a cross-sectional view of the cubic puzzle shown in FIG. 7.
Figure 9:
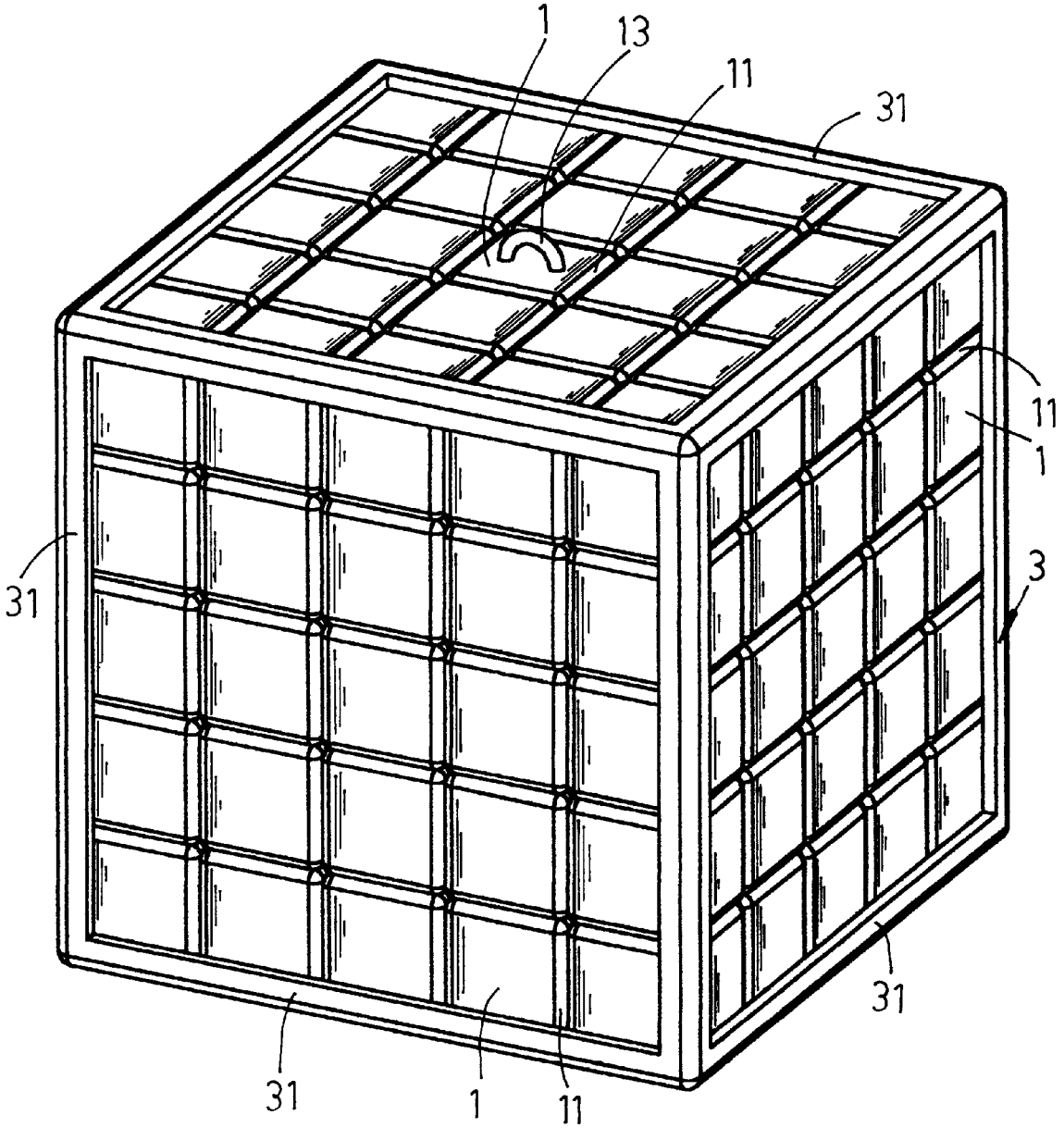
FIG. 9 illustrates still another alternate form of the cubic puzzle according to the present invention.

The combination cube can be formed of total $4^3$=64 blocks, or $5^3$=125 blocks. In the embodiment shown in FIGS. 7 and 8, the cubic puzzle is comprised of a cubic holder frame 3, a center base block 2, and 56 puzzle blocks 1, and the size of the center base block 2 is approximately equal 8 puzzle blocks 1. In the embodiment shown in FIG. 9, the cubic puzzle is comprised of a cubic holder frame 3, a center base block 2 (not shown), and 98 puzzle blocks 1, and the size of the center base block 2 is approximately equal to 27 puzzle blocks 1. In general, no matter how many blocks form the combination cube, the combination has a center base block and a number of puzzle blocks horizontally vertically aligned at each of the six sides.

Referring to FIGS. from 10 through 12, the cubic puzzle is comprised of a combination cube formed of a center base block 2' (not shown) and 26 puzzle blocks 1', and a transparent cubic holder frame 4' holding the blocks 1' and 2'. The center base block 2' is a solid block. The puzzle blocks 1' are hollow blocks each have the respective six sides marked with a respective particular design, and an iron sheet 12' on the inner surface of each of the respective six sides. Each of the six sides of each puzzle block 1' has the four side edges chamfered 11' for easy movement when the user shifting the puzzle blocks 1' to change the combination. The center base block 2' is a plain block of size approximately equal to the puzzle blocks 1', having no magnetic power. One puzzle block 1' has one side fixedly mounted with a pull ring 13', and a pull cord 14' fastened to the pull ring 13'. The transparent cubic holder frame 4 is a cubic case having one open side covered with a cover plate 41. The cover plate 41 has a center through hole 411. The pull cord 14' is inserted through the center through hole 411 and extended to the outside of the cubic holder frame 4. When playing the game, the pull cord 14' is lifted with the hand to take the cover plate 41 and the corresponding puzzle block 1' away from the cubic holder frame 4, leaving a space equal to one puzzle block for displacement of the puzzle blocks 1'. Thus, the user can use a magnetic stick 5 to shift the puzzle blocks 1' in the cubic holder frame 4, so as to change the combination.

Figure 10:
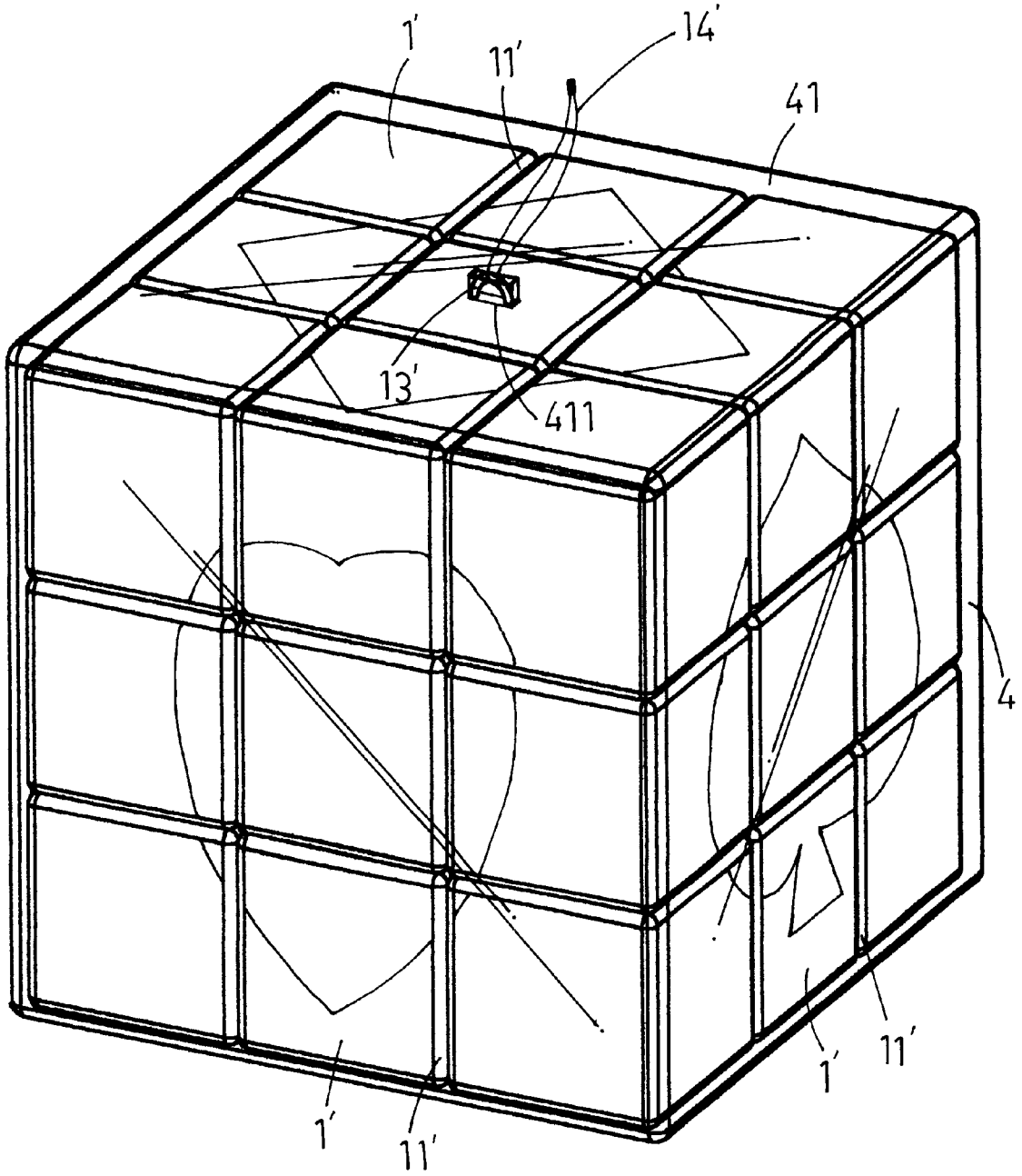
FIG. 10 shows still another alternate form of the cubic puzzle according to the present invention.
Figure 11:
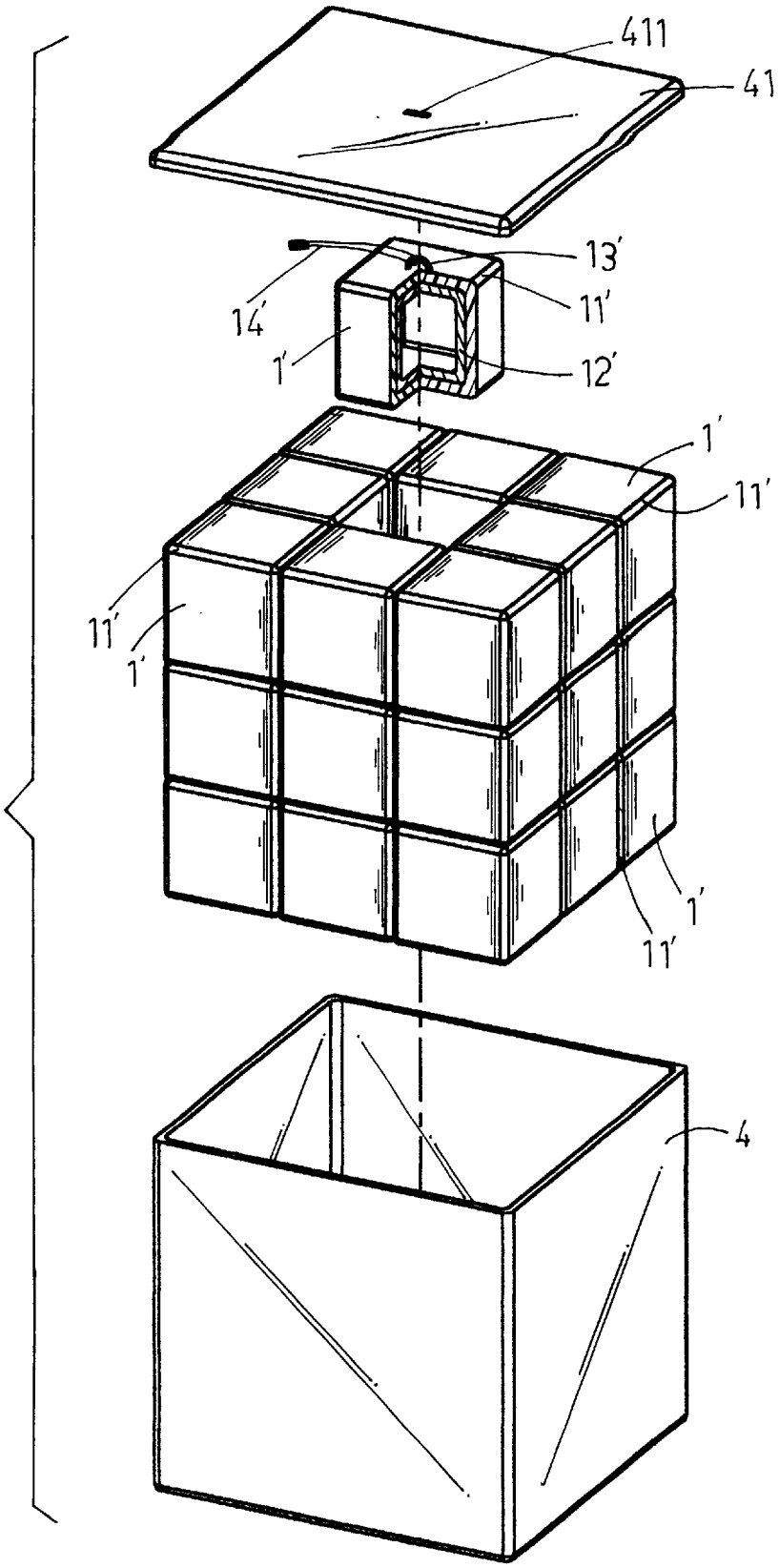
FIG. 11 is an exploded view, partially cutaway, of the cubic puzzle shown in FIG. 10.
Figure 12:
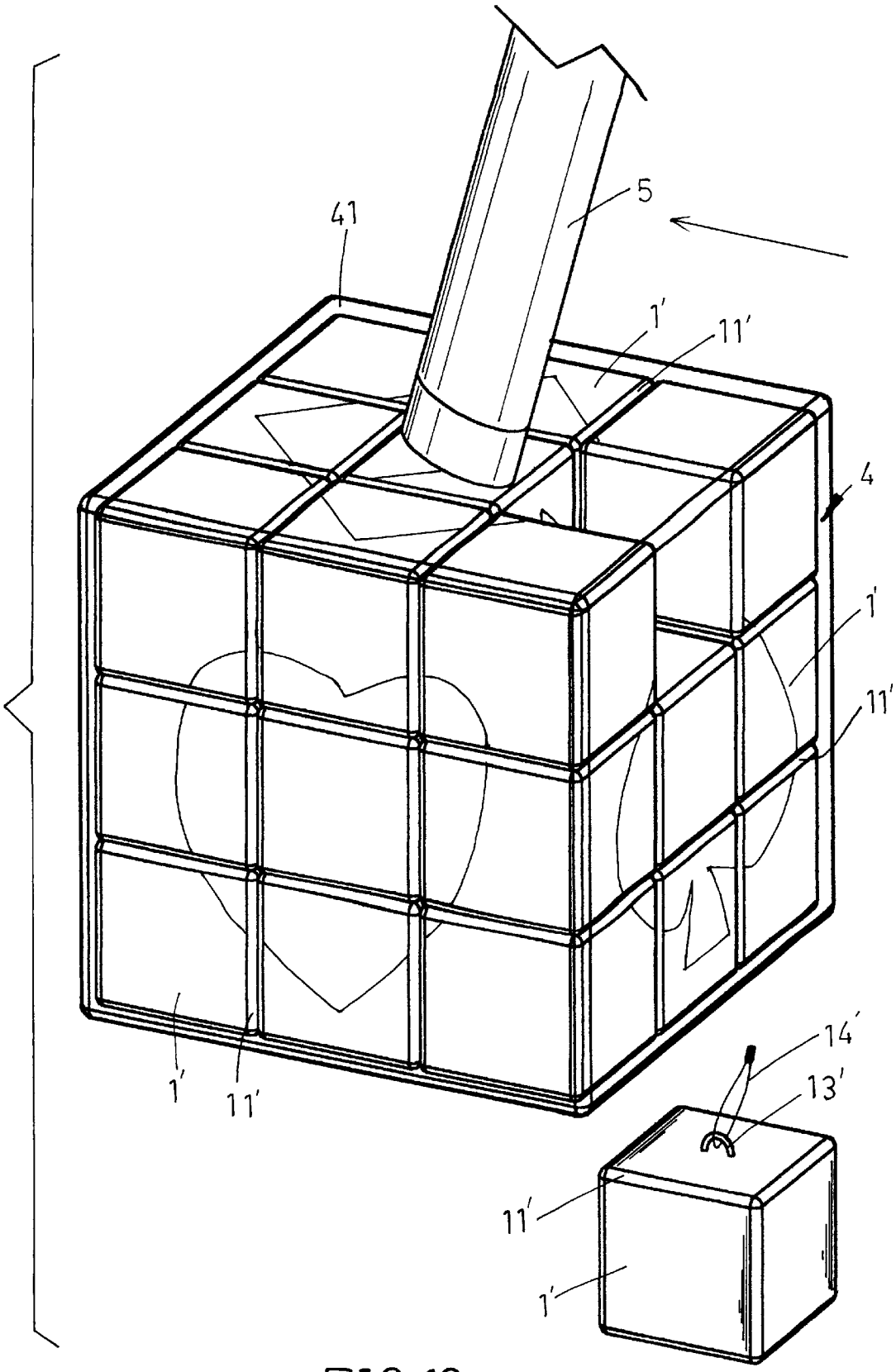
FIG. 12 is an applied view of the cubic puzzle shown in FIG. 10.
Figure 13:
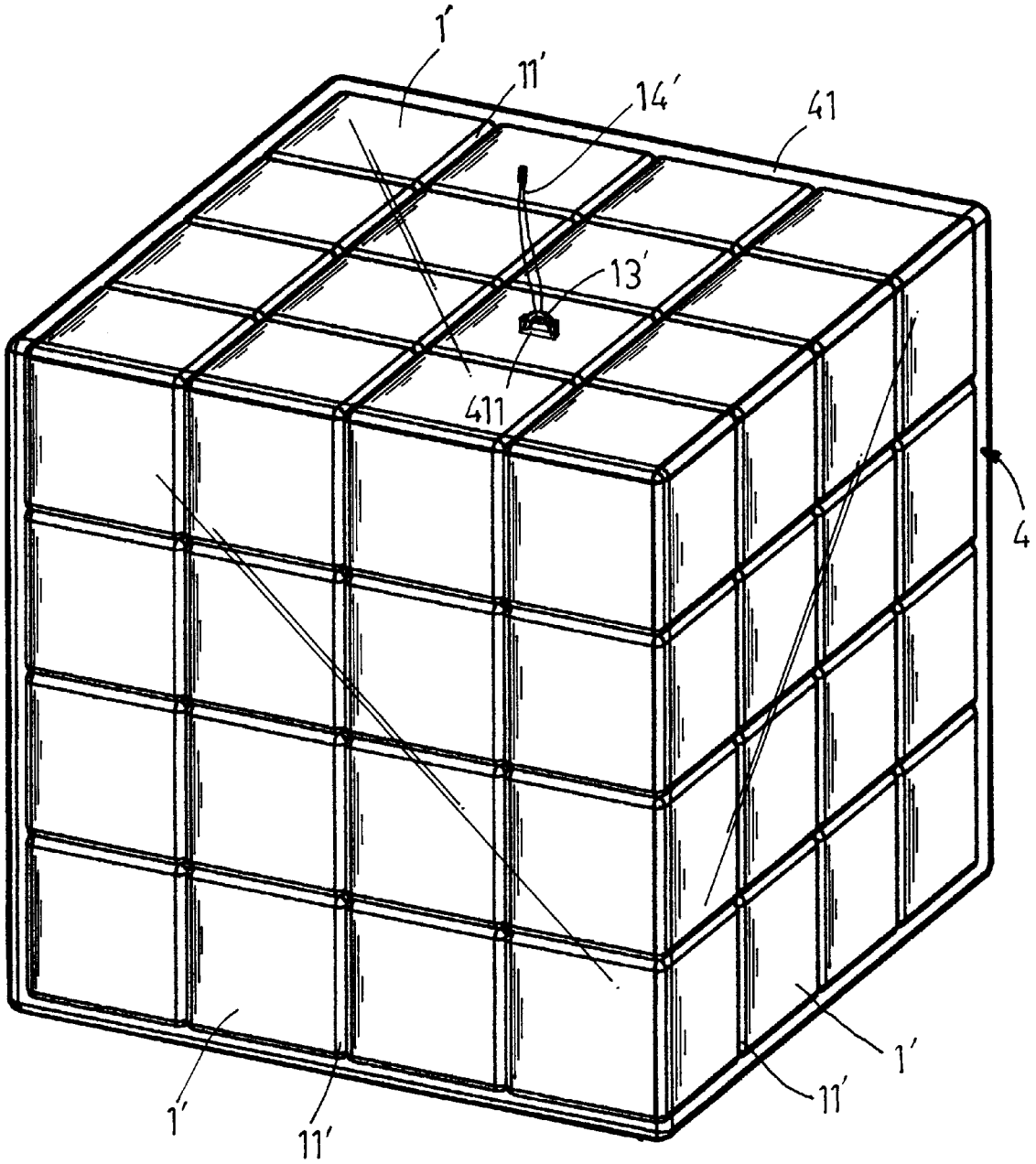
FIG. 13 shows still another alternate form of the cubic puzzle according to the present invention.
Figure 14:
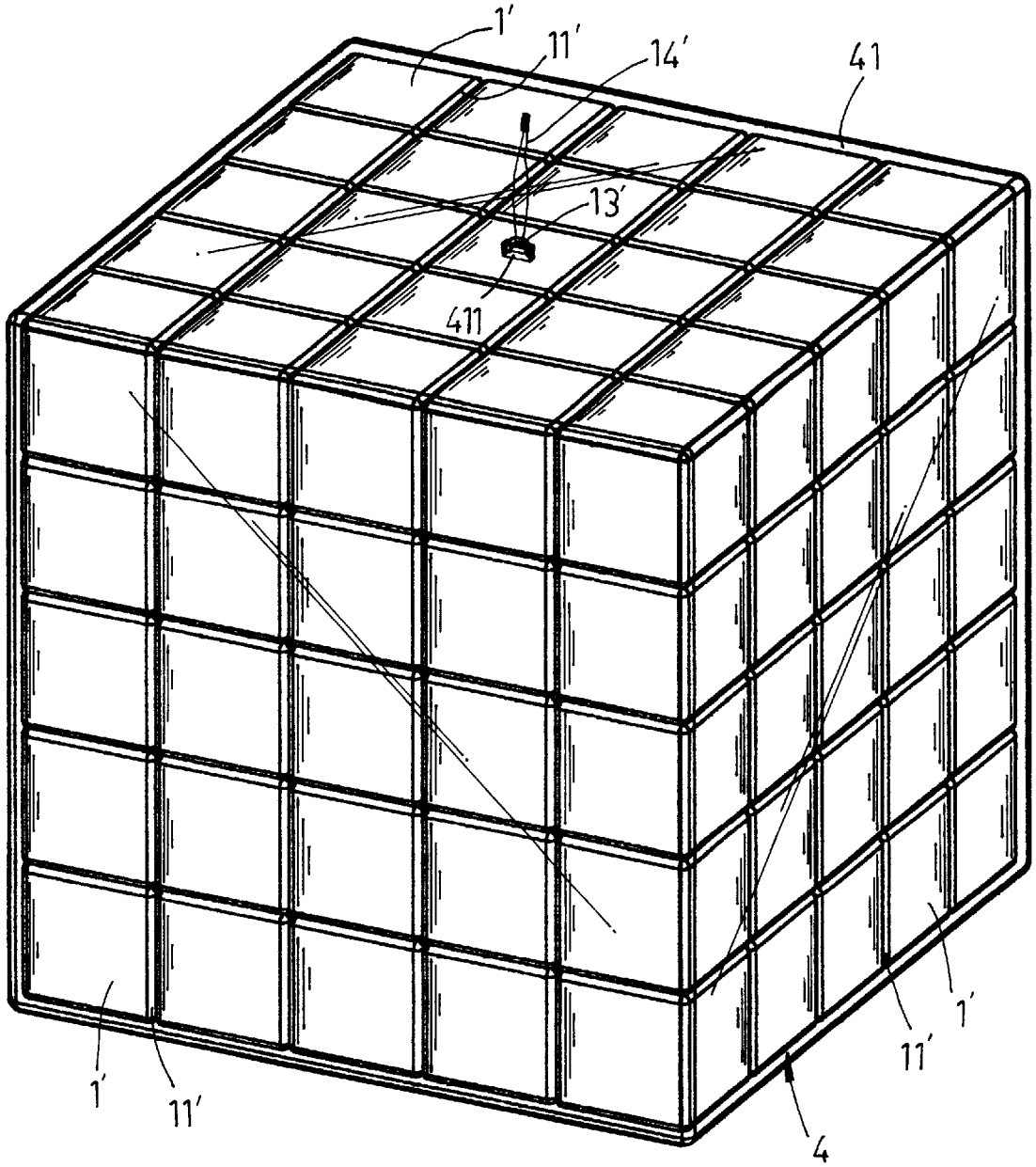
FIG. 14 shows still another alternate form of the cubic puzzle according to the present invention.
Figure 15:
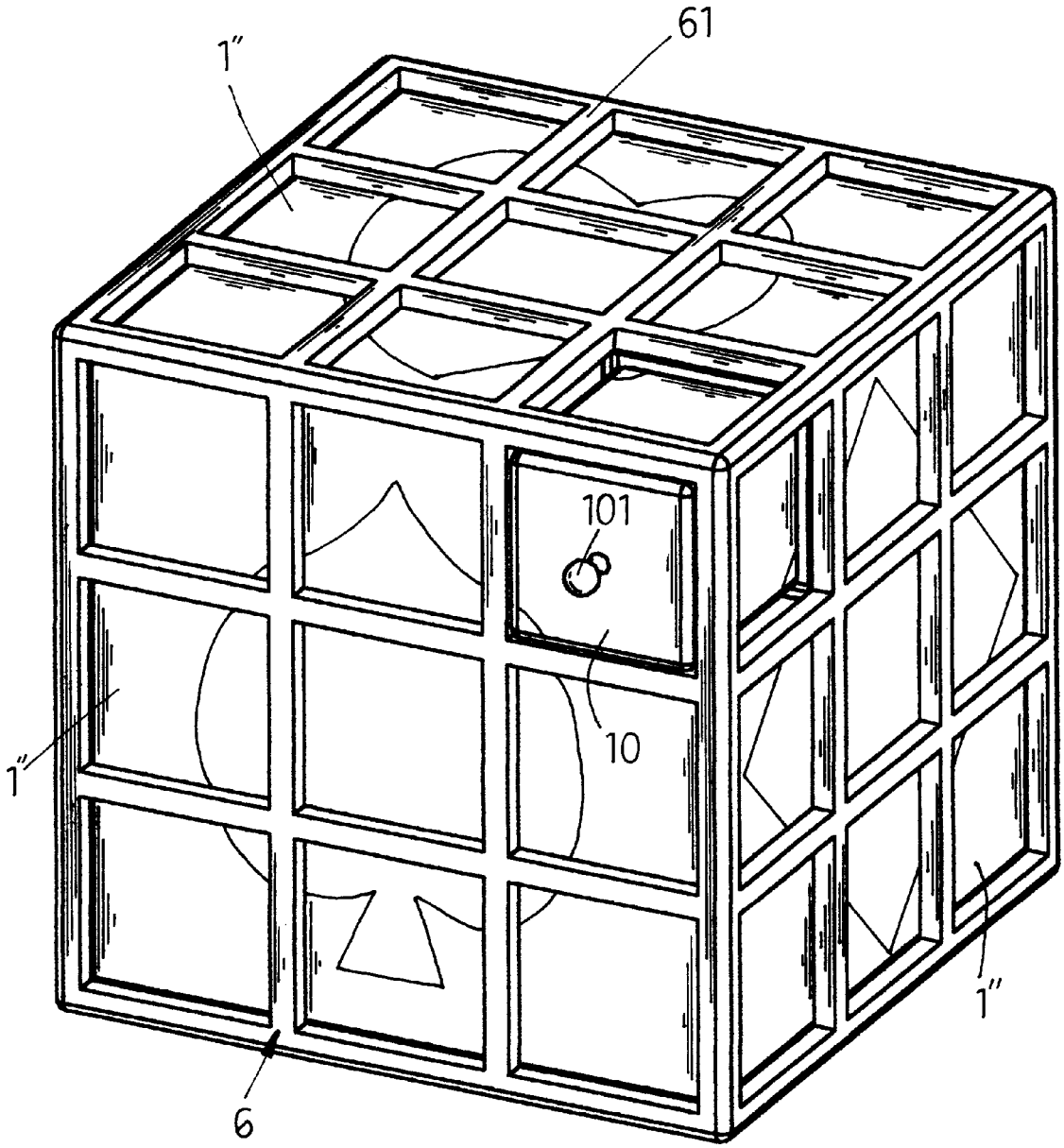
FIG. 15 shows still another alternate form of the cubic puzzle according to the present invention.
Figure 16:
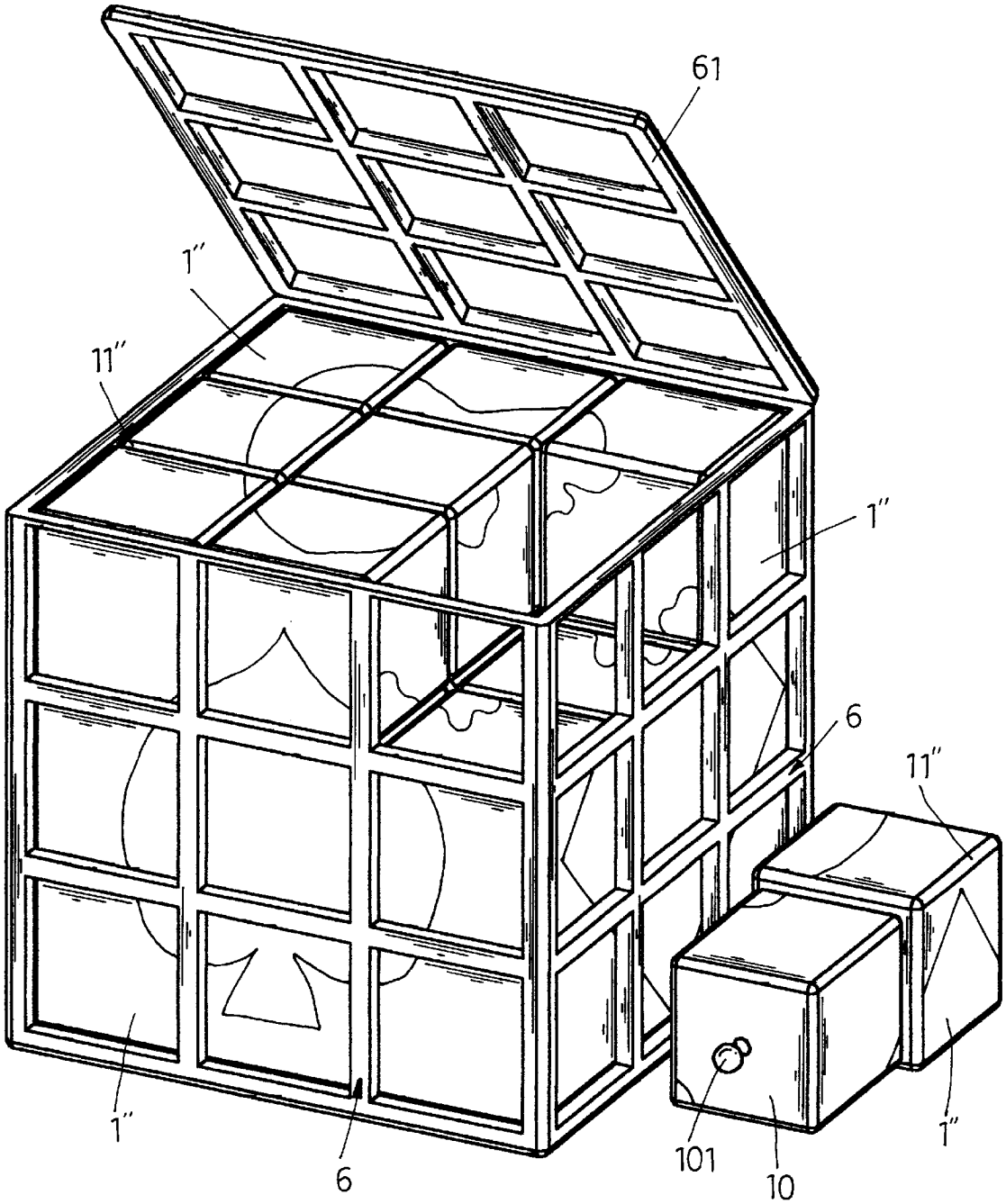
FIG. 16 illustrates the cubic puzzle of FIG. 15 opened, the insert puzzle block and one puzzle block taken out of the cubic holder frame.
Figure 17:
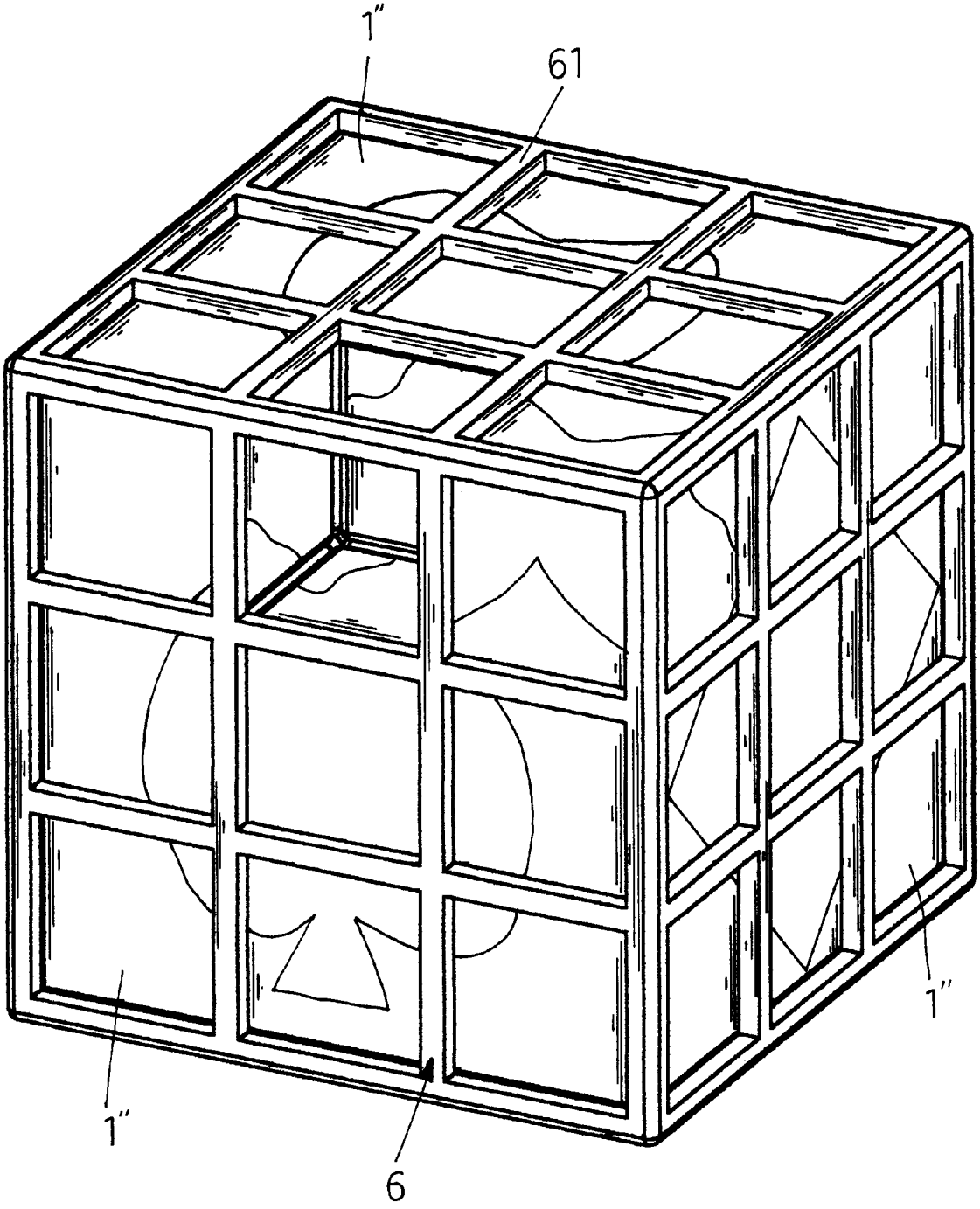
FIG. 17 illustrates the cubic puzzle of FIG. 15 played after removal of the insert puzzle block.

FIGS. 13 and 14 show two alternate forms of the embodiment of FIG. 10.

Referring to FIGS. from 15 through 17, the cubic puzzle is comprised of a combination cube formed of a center base block 2" (not shown) and 26 puzzle blocks 1", and a cubic holder frame 6 holding the blocks 1" and 2". The cubic holder frame 6 has six latticed rectangular open sides 61. The open spaces in each latticed rectangular open sides 61 are transversely longitudinally aligned, are of equal size slightly, and are smaller than the puzzle blocks 1". One of the latticed rectangular open sides 61 has one peripheral side hinged to the cubic holder frame 6 and the other three peripheral sides are not connected to the cubic holder frame 6. Therefore, the hinged latticed rectangular open side 61 can be opened for enabling the combination cube of the center base block 2" and the puzzle blocks 1" to be put into the inside of the cubic holder frame 6 or taken out of the cubic holder frame 6. Each of the six sides of each puzzle block 1" has the four side edges chamfered 11" for easy movement when the user shifting the puzzle blocks 1" to change the combination. This embodiment eliminates the installation of iron sheets in each puzzle block 1" and the use of magnetic stick means to shift the puzzle blocks 1". Because the size of the open spaces in the latticed rectangular open sides 61 of the cubic holder frame 6 is smaller than the puzzle blocks 1", the puzzle blocks 1" do not fall out of the cubic holder frame 6 when shifted. Further, the puzzle blocks 1" include an insert puzzle block 10 of relatively smaller size. The insert puzzle block has a finger rod 101 at its one side. Through the finger rod 101, the insert puzzle block 10 can be conveniently taken out of the cubic holder frame 6 with the hand, leaving a puzzle block space in the cubic holder frame 6 for shifting the puzzle blocks 1" with the finger. After opening the hinged latticed rectangular open side 61, the user can take the combination cube of the center base block 2" the puzzle blocks 1" out of the cubic holder frame 6, and then re-arrange the combination of the puzzle blocks 1".

A prototype of cubic puzzle has been constructed with the features of FIGS. 2~17. The cubic puzzle functions smoothly to provide all of the features discussed earlier.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A cubic puzzle comprising:

a cubic holder frame having six open sides, and peripheral ribs connected to one another around said six open sides; and a set of cubic blocks set in said cubic holder frame forming a combination cube, said set of cubic blocks including a magnetic center base block, and a plurality of puzzle blocks aligned within said cubic holder frame around said center base block and movable between a plurality of positions around said center base block within said cubic holder frame, said set of cubic puzzle blocks being hollow cubic blocks each having respective six sides externally marked with a respective design and internally mounted with an iron sheet attractable to the magnetic center base, said set of cubic puzzle blocks including one removable puzzle block having a pull ring fixedly provided at one side thereof by which said removable puzzle block is taken out of said cubic holder frame thereby enabling other puzzle blocks to be shifted around said center base block within said cubic holder frame to change a combination of the cubic blocks.

2. A cubic puzzle comprising:

a set of cubic blocks arranged together and forming a combination cube, said set of cubic blocks including a solid center base block and a plurality of puzzle blocks aligned around said solid center base block, said puzzle blocks being hollow cubic blocks each having respective six sides externally marked with a respective design and internally mounted with an iron sheet, four edges of each of the respective six sides being chamfered, said set of cubic puzzle blocks including one removable puzzle block having one side fixedly mounted with a pull ring and a pull cord mounted at said pull ring; and, a transparent cubic holder frame adapted to hold said cubic blocks for enabling said puzzle blocks to be shifted with a magnetic stick from position to position around said center base block to change the combination of said cubic blocks, said transparent cubic holder frame being a cubic case having an open side covered with a detachable cover plate.

3. The cubic puzzle of claim 2 wherein said detachable cover plate of said transparent holder frame has a center through hole through which said pull cord passes.

4. A cubic puzzle comprising a cubic holder frame, and a set of cubic blocks set in said cubic holder frame to form a combination cube, said set of cubic blocks including a center base block, and a plurality of puzzle blocks aligned within said cubic holder frame around said center base block and movable between a plurality of positions around said center base block within said cubic holder after removal of one of said set of cubic puzzle blocks, wherein said cubic holder frame comprises six latticed rectangular open sides, each side defining a plurality of transversely longitudinally aligned rectangular open spaces of size smaller than said puzzle blocks, and said set of cubic puzzle blocks including one insert puzzle block of relatively smaller size.

5. The cubic puzzle of claim 4 wherein said six latticed rectangular open sides include a movable latticed rectangular open side hinged to said cubic holder frame.

6. The cubic puzzle of claim 4 wherein said insert puzzle block has a finger rod at one side thereof.

* * * * *